US006494538B1

(12) United States Patent
Alvestad

(10) Patent No.: US 6,494,538 B1
(45) **Date of Patent: *Dec. 17, 2002**

(54) ADJUSTMENT DEVICE FOR BEDS AND OTHER RECLINING OR SEATING FURNITURE

(76) Inventor: Kjartan Alvestad, N-6222, Ikornnes (NO)

( * ) Notice: Subject to any disclaimer, the term of this patent is extended or adjusted under 35 U.S.C. 154(b) by 0 days.

This patent is subject to a terminal disclaimer.

(21) Appl. No.: 09/380,200

(22) PCT Filed: Feb. 25, 1998

(86) PCT No.: PCT/NO98/00057

§ 371 (c)(1),
(2), (4) Date: Aug. 26, 1999

(87) PCT Pub. No.: WO98/37792

PCT Pub. Date: Sep. 3, 1998

(30) Foreign Application Priority Data

Feb. 28, 1997 (NO) ..... 19970949

(51) Int. Cl.[7] ..... A47C 1/02
(52) U.S. Cl. ..... 297/316; 5/618
(58) Field of Search ..... 297/316, DIG. 10, 297/301.1, 300.1, 45, 317, 342, 354.13, 325, 318, 320; 5/617, 618, 619, 620

(56) References Cited

U.S. PATENT DOCUMENTS

| | | | | | |
|---|---|---|---|---|---|
| 2,304,199 | A | * | 12/1942 | Pinnow | 297/316 |
| 2,468,765 | A | * | 5/1949 | Lorenz | 5/69 |
| 3,589,715 | A | * | 6/1971 | Mark | 297/316 X |
| 3,954,195 | A | * | 5/1976 | Deuchar | 297/316 X |
| 4,403,357 | A | | 9/1983 | Degen | 5/66 |
| 4,623,194 | A | * | 11/1986 | Pillot | 297/316 |
| 4,751,754 | A | | 6/1988 | Bailey et al. | 5/68 |
| 4,761,033 | A | * | 8/1988 | Lanuzzi et al. | 297/320 X |
| 5,902,220 | A | * | 5/1999 | Lin | 297/316 X |
| 6,138,303 | A | * | 10/2000 | Alvestad | 5/618 |
| 6,247,753 | B1 | * | 6/2001 | Alvestad | 297/317 X |

FOREIGN PATENT DOCUMENTS

| | | |
|---|---|---|
| DE | 332 586 | 10/1971 |
| DE | 146665 | 12/1983 |
| DE | 34 01 701 | 8/1984 |
| DK | 125771 | 9/1973 |
| DK | 145563 | 12/1982 |
| FI | 89867 | 8/1993 |
| GB | 2 194 142 | 3/1988 |

* cited by examiner

*Primary Examiner*—Peter M. Cuomo
*Assistant Examiner*—Stephen Vu
(74) *Attorney, Agent, or Firm*—Finnegan, Henderson, Farabow, Garrett & Dunner, L.L.P.

(57) ABSTRACT

The adjustment of the angular setting is provided between the parts (R, S, F) in a reclining or sealing article of furniture, which has two or more mutually adjustable, articulated parts which together form the frame of the article, and where the frame is mounted in a support member (A) by of transverse axes or axis journals (2, 3, 5), the back member's (R) axis (2) is securely mounted in a pivot bearing (11). The axes (3, 5) of the remaining part(s) (s/ or S and F respectively) are movably mounted in the support member's longitudinal direction. The back member's (R) axis (2) is mounted at a distance from the joint connection (1) of the seat member (S).

14 Claims, 16 Drawing Sheets

ADJUSTMENT DEVICE FOR BEDS AND OTHER RECLINING OR SEATING FURNITURE

BACKGROUND OF THE INVENTION

1. Field of the Invention

The invention concerns a device for reclining or seating furniture, wherein the piece of furniture has two or more mutually adjustable, articulated members, which together form an adjustable frame for support of a mattress, cushions, upholstery or the like, where the adjustable frame is mounted in a support member by means of horizontal axles/dowels/stays/sliding elements or the like which constitute pivot points or fulcrums for the mutually adjustable, articulated members, where the back member has a fixed pivot point in relation to the support member, located at a distance from the linkage to the seat member, and that the pivot points for the remaining frame members during adjustment are movable in the length direction of the furniture.

2. Description of the Related Art

In order to obtain different user positions for a piece of reclining or seating furniture, it is usually designed with a frame composed of two or more interlinked parts which form the support for a mattress, cushions, upholstery or the like. The parts of the frame may be incorporated with the mattress, the upholstery etc. or a mattress may be mounted on the frame part, the mattress being designed in such a way that it can follow the frame to the various possible settings. The frame is mounted in a support member which may be mounted in the piece of furniture or form an integrated part of the furniture and it may be in the form of a side member, a gable, a frame or as fixed components. The piece of furniture may be a bed, a chaise lounge, a divan, a bench, a sofa, a chair, etc. In the following description and claims the terms frame, frame member, support member and furniture are intended to cover all such variants.

There are a number of different kinds of reclining and sitting furniture currently on the market equipped with adjustment devices for setting different angles between the back member, the intermediate member or seat member and the foot member in order to provide the article with alternative user positions. The most common examples are adjustable chairs, where the back member and seat member can be set at an angle in relation to each other in order to provide a position of rest or a more active sitting position. Similar solutions have been developed for beds, offering the possibility of assuming a position which is more suitable for reading in bed, etc.

Such adjustment facilities for beds and chairs are employed not only for reasons of comfort, but are particularly important in nursing or illness situations, such as in hospitals or in nursing institutions where the user has to stay for lengthy periods, e.g., in a bed, or in connection with therapeutic chairs for dentists, doctors, etc.

Examples of adjustable reclining or seating furniture can be found in U.S. Pat. No. 4,751,754 and Finnish Pat. No. 89867, both of which disclose adjustable hospital beds, as well as in Danish Pat. Nos. 125771 and 145563, both of which disclose examples of adjustable installation frames for beds. To some extent these previously known constructions have a relatively complicated design. They offer the possibility of different angular adjustments for both the back member, seat member and foot member of the surface of a bed. In designs where the foot member is connected to the seat member and is slidingly guided in the frame of the bed, the foot member will be raised above the surface of the bed in the knee area, which is not always desirable. Alternatively, special joint constructions or additional surface elements have been employed.

In U.S. Pat. No. 4,403,357 a piece of reclining furniture is described, having intermediate elements, each being connected to the adjacent ends of the back member and a leg support member portion by means of pivot joints, which are preferably constructed as elastic pivot joints. Thus the intermediate elements of the under-mattress are connected in a freely suspended manner to the adjacent portions by means of pivot points. The intermediate member permits automatic adjustment of the prevailing sitting position to any desired load conditions. However a motor as an active activator is used in connection therewith.

SUMMARY OF THE INVENTION

The object of the present invention is to provide an adjustment device which permits the desired changes in angular adjustment between the seat and the back member, or between the back member, the seat member and the foot member of the frame of an article of furniture. The adjustment device should be simple in design and relatively inexpensive to manufacture, while at the same time it should be possible to perform the angular adjustment either manually or by simple operating means, and preferably with only one single exercise of force.

This object is achieved with an adjustment device of the type mentioned in the introduction, which is characterized by the features presented in the patent claims.

The invention is particularly concerned with a three-part frame for use in a bed or chair, but the invention may also be employed in connection with a two-part construction or a construction with more than three frame members. In every case the back member will be pivotally mounted in a fixed horizontal transverse axis or by means of axis journals some distance above the hinge or link connecting the back member with the seat member. A movement of the back member will result in a movement or rotation of the frame's other links via the articulations. The description is based on a reclining position where all the parts of the piece of furniture are located in a common, substantially horizontal plane from which position the parts are moved by raising the back member of the frame. In this connection it should be emphasized that in this respect, the description is not intended to be a limiting factor, since the basic position in a chair configuration for a position of rest might just as well be with the back raised, e.g., 60°. Thus the basis of a reclining position is only used to facilitate the description of the embodiments.

The essential and characteristic feature of the invention is that the rotation of the part of the frame results in a mutual movement of the fulcrum relative to the frame and/or the frame's support member in the furniture's longitudinal direction, either in the support member's plane or along a circular arc based on this plane. This relative movement does not necessarily mean that the fulcrum has to be moved, an alternative being that the frame member may be moved relative to the fulcrum with a similar effect.

In a first embodiment, the seat member is pivotally mounted in a fixed horizontal transverse axis or with axis journals and mounted in a mounting or guide means which permits movement of the transverse axis slidably in an approximately straight line or approximately parallel in relation to the back's suspension axis. The foot/leg member is pivotally mounted in a movable horizontal transverse axis or by means of axis journals which are mounted on a mounting device which moves the transverse axis slidably in an approximately straight or approximately parallel line. in relation to the back's and the seat's suspension axes. In the case of chairs there are not necessarily any foot members. If desired, the chair can be extended with a separate stool or the like.

The lower part of the back, which extends from the mounting axis to the articulation with the seat member can be equipped with a lever which can be influenced by a force, e.g., from a driving mechanism. In order to achieve further adjustment relative to the floor area, according to a further feature of the invention the furniture frame can be combined with a tilting device which can tilt the support frame about a desired smaller angle, e.g., ±12°.

By means of the invention it may be said that adjustable seating furniture is supplied with the advantages which adjustable beds have, and that adjustable beds are provided with the same advantages which exist in adjustable seating furniture. The adjustment device according to the invention offers the possibility of adjusting the angle between the back member and the seat member between 180° and 90° and between the seat member and a possible foot member between 180° and 200–300°. In addition the angles of the seat member and a possible foot member can be adjusted relative to the floor, even though the back member does not move when the angles deviate from 180° and a tilting effect may also be exercised of the order of ±12°. The possibility is thereby obtained of adjusting an angle with the back and the seat member from 180°, which means that the back and seat members are located on the same plane, to an angular position between the parts. The seat member and the leg member can be angularly adjusted between 180° and approximately 100° or more. The previously known adjustable beds are normally also hinged or articulated between the individual parts or sections and are usually constructed with heavy, complicated and expensive fittings which by means of manual operation or motor drive will move the various parts into the desired angles. With adjustment devices according to the invention, a simpler, lighter and more reasonably priced adjustment concept is provided in order to satisfy old and new functional requirements in modern times where, amongst other things, people have more leisure. The object is to obtain flexible positions of rest and/or positions which offer the possibility for reading, watching TV or video, surfing on the Internet and the like, thereby reaching new market segments with functional solutions which cover the new requirements for young and old, healthy and handicapped.

As will be illustrated by the following embodiments, the movement of the fulcrums for the seat member and the foot member may be designed in many different ways. The fulcrum, i.e. the mounting point, can be moved by moving a pin on the frame member in grooves provided in the support member or vice versa. The degree of angular adjustment will be dependent on the chosen solution and, particularly in the case of fixed fulcrums where the frame member is moved relative to the fulcrum, it will also be possible to perform an adjustment enabling the beds to be adjusted for other angular variations by means of the same mounting method. If a solution with levers is chosen, the fulcrums for the frame members will be moved along circular paths in the furniture's longitudinal direction. The choice of solution will depend on the piece of furniture which is to be manufactured and all of these variations are intended to fall within the scope of the invention.

BRIEF DESCRIPTION OF THE DRAWINGS

The invention will now be described in more detail by means of embodiments which are illustrated in the drawings, in which.

DETAILED DESCRIPTION OF THE PREFERRED EMBODIMENTS

Figure 1:
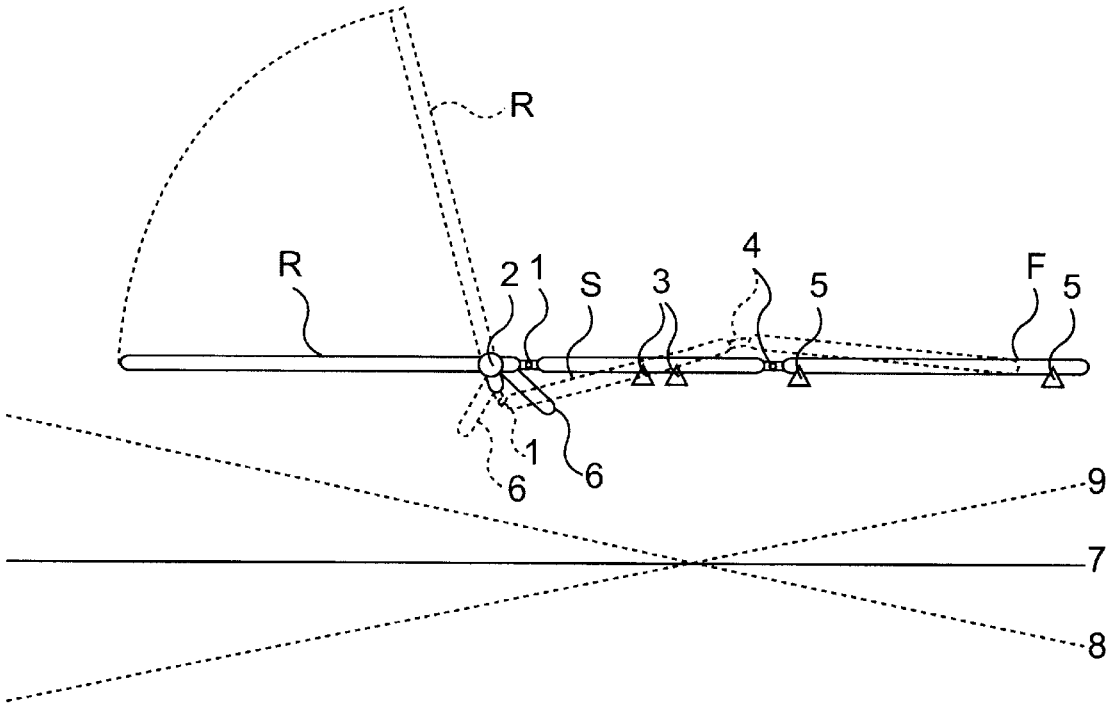
FIG. 1 is a schematic drawing illustrating a design of a bed base or the like with the adjustment device according to the invention.

In the drawings, embodiments of the invention are illustrated in a purely schematic manner with no details of the furniture included, illustrating, e.g., the design of the support member. As mentioned above, the support member may be designed as side members and a connection device 10, gables, frames or other fixed components and the piece of furniture may be a bed, chaise longue, divan, bench, sofa, chair, etc. These constructional elements will vary according to the furniture design and a person skilled in the art will have no trouble in adapting the inventive part to the practical use. The perspective views also illustrate only the framework which constitutes the support structure of these constructional elements and, e.g., the actual mounting member which will hold a mattress or upholstery is not included. All such elements will naturally be incorporated by a person skilled in the art. Similarly, in a number of the drawings there are only shown beam elements of the support member, since these beam elements can be incorporated in the actual support structure of the piece of furniture. Alternatively, these beam elements may constitute an integrated part of the actual support structure or the mounting points may be provided directly in the support structure. All such variants are considered to be obvious to a person skilled in the art and are therefore not described in more detail herein.

Figure 8A:
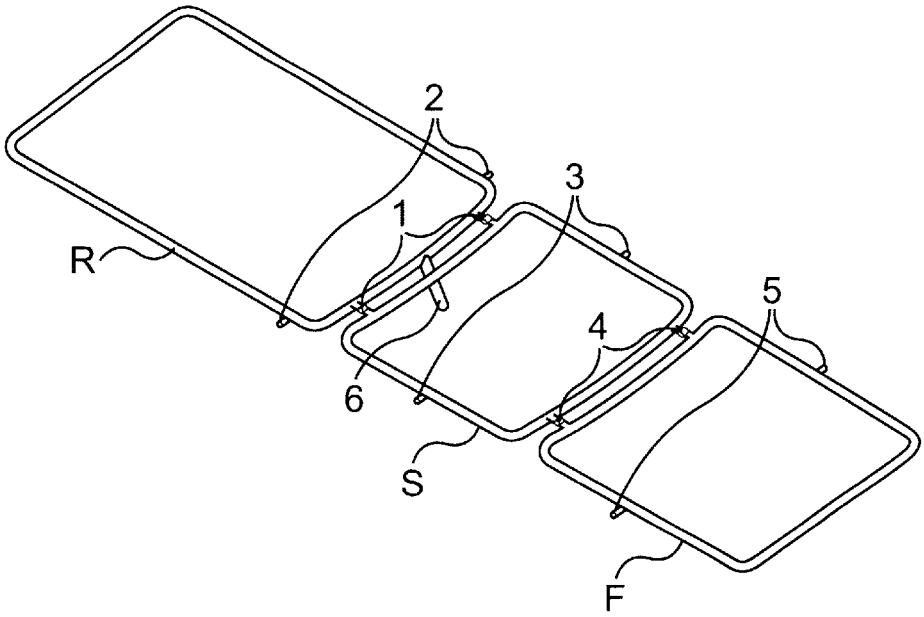
FIG. 8A is a perspective view illustrating the furniture frame.

The adjustment device according to the invention will now be explained in more detail in connection with the schematic illustration presented in FIG. 1 of the drawing. The drawing illustrates in a side view the invention in connection with a design of a bed base or the like, where the furniture frame or the bed frame consists of three sections or parts, R which is the back member, S which is the seat member and F which is the foot or leg member of the bed frame. Each of these three parts is equipped with a transverse axis or axis journals, as illustrated in FIGS. 8 and 9. The axis journals for the back member R are designated 2, the axis journals for the seat member are designated 3 and the axis journals for the leg member F are designated 5. The parts of the frame are hinged or linked to one another by means of hinged joints which again are best illustrated in FIGS. 8 and 9, in which they are designated 1 and 4 respectively.

During angular adjustment of the parts R, S and F in relation to one another, the parts will rotate about the linkage points 1 and 4, while the axis journal connection to the support member remains located in the same plane. In FIGS. 8 and 9 the support member is designated A and B respectively, and the attachment or displacement areas for the axis journals are designated 11, 12 and 13. It can be seen from FIGS. 8 and 9 that the axis journals 3 and 5 have displacement possibilities in the slot-shaped openings, while the back member's axis journal 2 has a fixed mounting.

The distance between axis journals, i.e. the fulcrum for the individual parts and the articulation between the parts determines the relative pattern of movement between the parts. These distances, i.e. the ratio between the distances between fulcrum and linkage point for back member R and seat member S are selected in such a manner that an infinitely variable adjustment of between 180° and 90° can be performed of the angle between seat member and back member.

Figure 2:
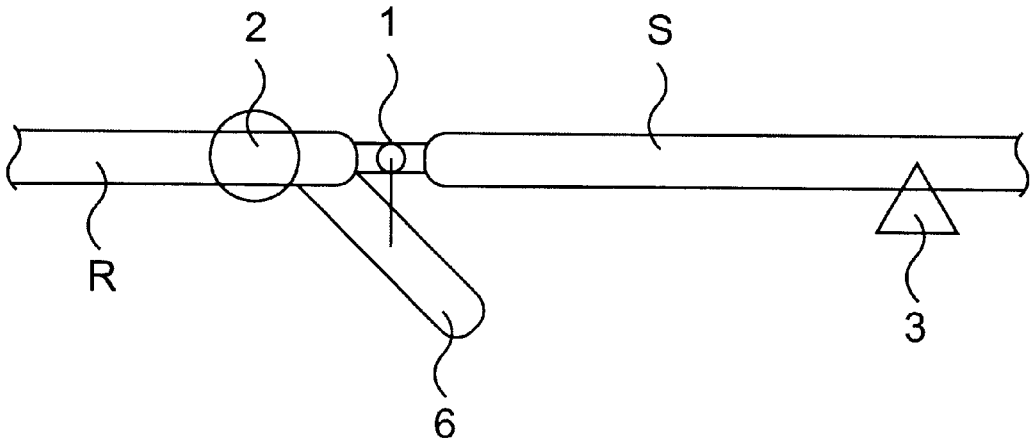
FIGS. 2 and 3 show details of the drawing in FIG. 1 illustrating the operating mechanism during angular adjustment between the back and seat members.
Figure 3:
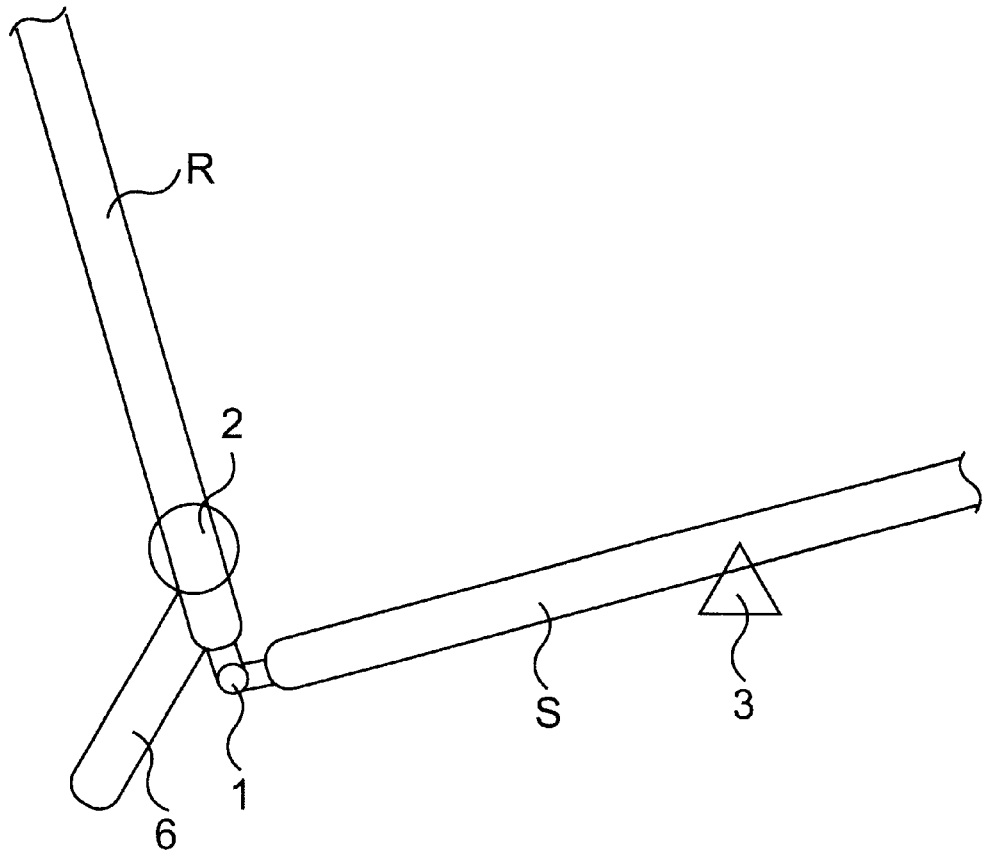
Figure 4:
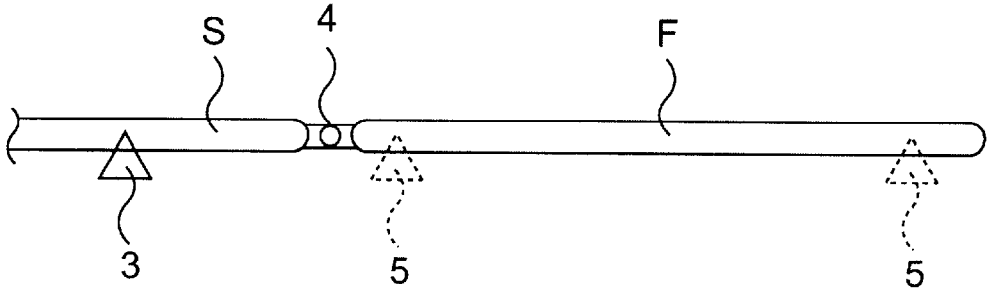
FIGS. 4–6 are views illustrating the principles of the invention during angular adjustment between the seat member and the foot member.
Figure 5:
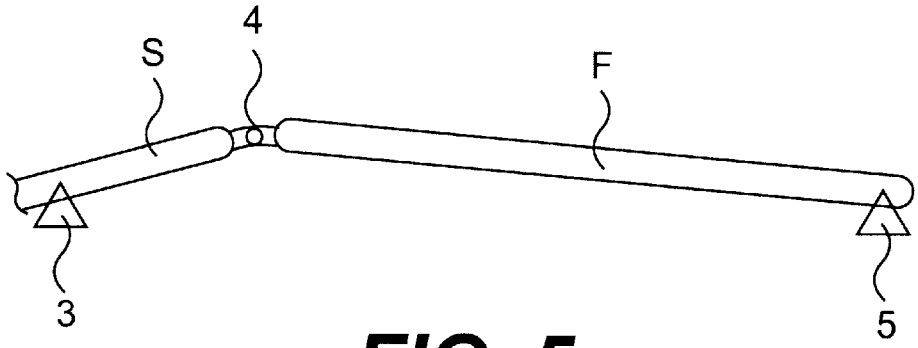
Figure 6:
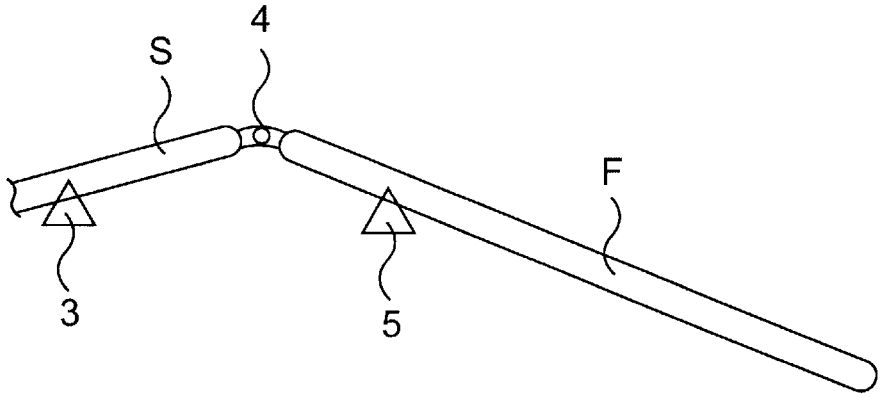

These two extreme positions are illustrated in FIG. 1, the position illustrated by a broken line showing an angular adjustment of 90° between the parts R and S. By means of this movement from the position illustrated by solid lines to the position illustrated by broken lines, the mounting point 2 for the back member will remain fixed, while the mounting point for the seat member will be moved towards the back member, while at all times remaining located in the plane of the bed frame. This adjustment is illustrated in more detail in FIGS. 2 and 3. Here it can be seen that the mounting points 2 and 3 remain located on the same plane.

By means of this displacement of the back member to an upright position, the seat member S, via the joint 4, will also influence the leg member F, which will be pulled along by the movement of the seat member. The joint 4 will thereby be pulled in the direction towards the back member and lifted slightly above the bed plane. At the same time, the mounting 5 will move in the groove 13, also in the direction towards the back member, thereby controlling the angular movement of the foot member. The length ratio between the slots 12 and 13 is preferably selected so that the foot member or the leg member will fall about an angle between 4° and 22°, depending on where on the leg or foot member the suspension point 5 is located. In FIGS. 1 and 4–6, this movement is indicated very prominently for illustrative reasons, but it may, of course, also be different to that which is shown in the figures. The movement mechanism for the foot member is illustrated on a larger scale in FIGS. 4–6.

In order to perform the angular adjustment of the back member in the simplest possible way, on the underside of the back member R, there is rigidly fastened an arm piece or a lever 6, which is also illustrated in FIGS. 8 and 9. Between this lever and a point on the support member or another attachment point there may be provided a pneumatic cylinder or an electrical actuator which, via the lever 6, provides for the angular adjustment and the locking of the back member R and thereby normally of all parts of the construction.

Figure 7:
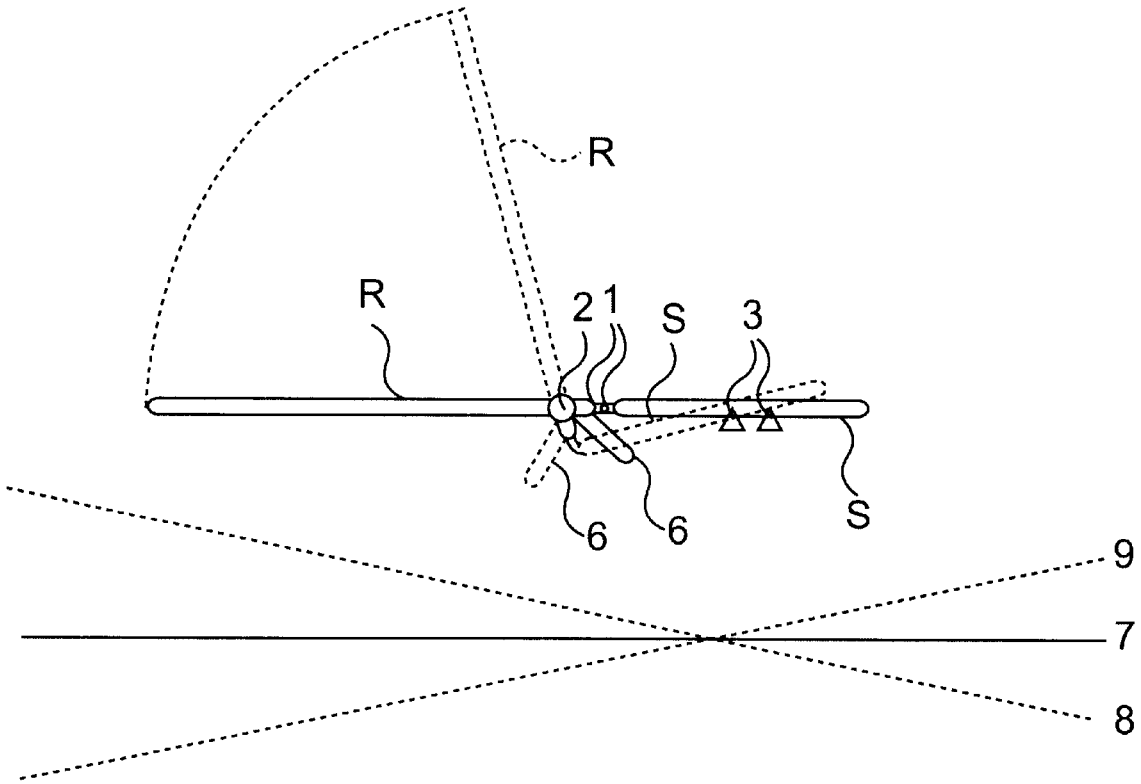
FIG. 7 is a drawing corresponding to FIG. 1 illustrating the adjustment device according to the invention for a chair design.

FIG. 7 illustrates the adjustment device for the invention employed in a chair. The design differs from that illustrated in FIG. 1 only in that the leg member F has been removed.

Figure 8B:
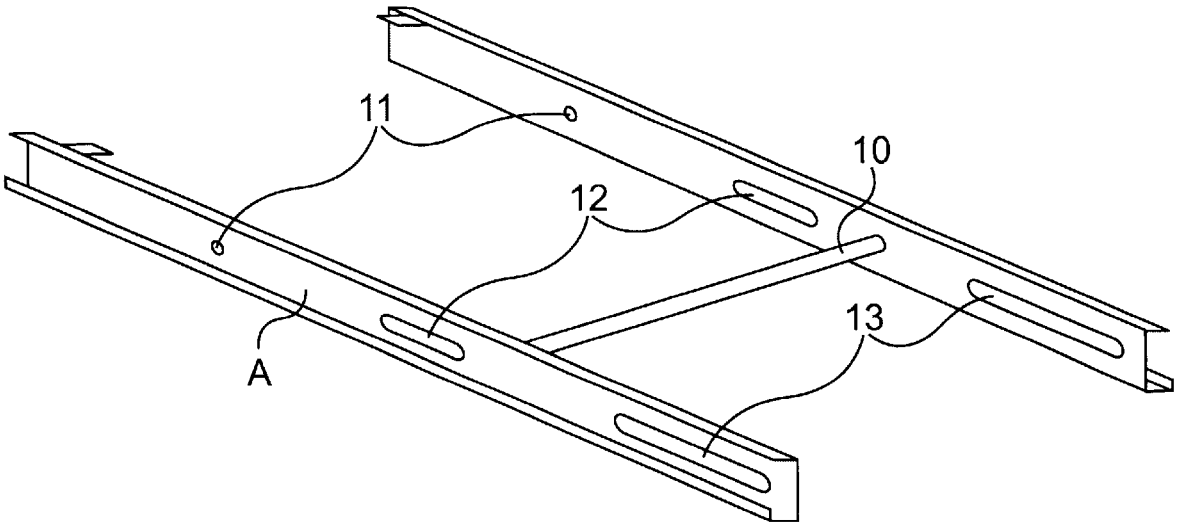
FIG. 8B is a perspective view of a support member, intended for mounting in a bed frame.
Figure 9A:
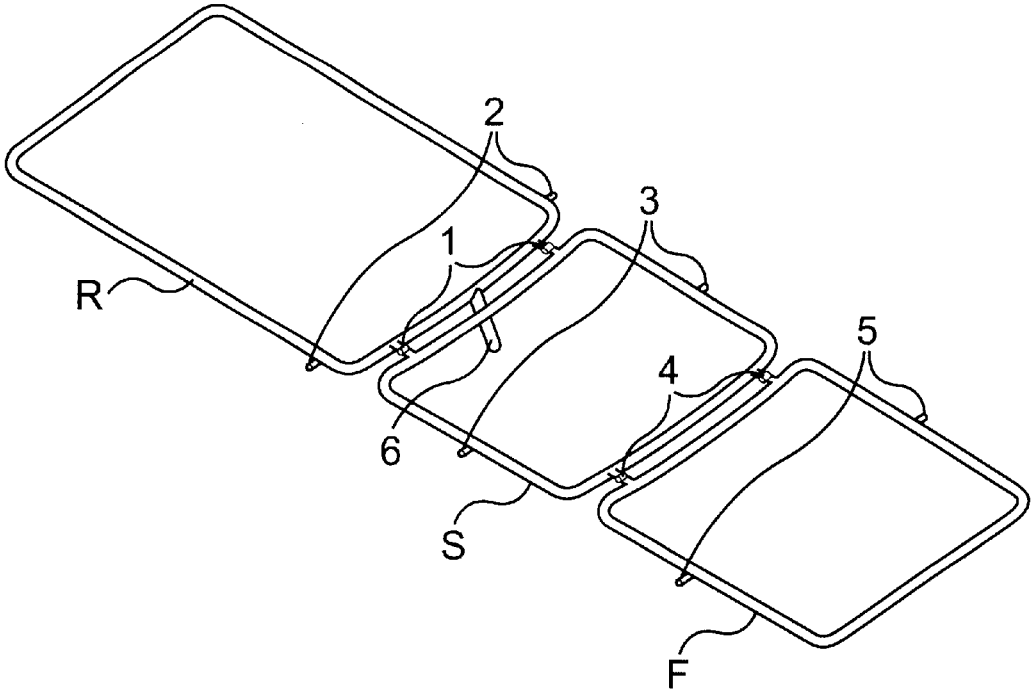
FIGS. 9A and 9B are similar perspective view illustrating a second design, where the support member is designed as a chassis.
Figure 9B:
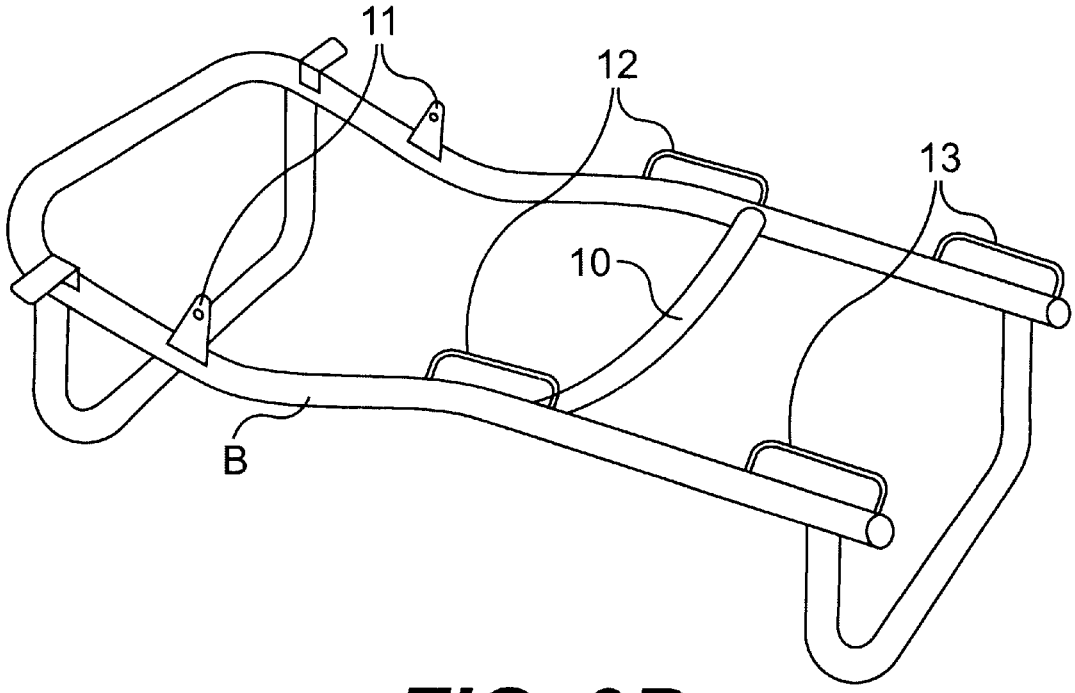

FIGS. 8 A/B and 9 A/B illustrate the use of two different support members, FIG. 8B showing a support member A which is intended for mounting in a bed frame or the like while FIG. 9B illustrates a design where the support member B is equipped with legs, i.e., designed as a chassis. In the design in FIG. 8B it will be the support member A with the parts R, S and F which are tilted. In a design with legs, as illustrated in FIG. 9B, it will also be possible to establish a tilting function. The tilting function will be particularly relevant, e.g., in connection with hospital or nursing home beds.

FIG. 1 also illustrates in a purely schematic form the said tilting movement for the support member, where the whole piece of furniture or the adjustable frame can be tilted, e.g., between the positions 8 and 9 in relation to the normal position 7, the settings 8 and 9 corresponding to angular adjustments of ±12°. It should be pointed out that the angular range may be both smaller and greater, and also different in the two directions, e.g., only ±12°.

In FIGS. 10–17, four further alternative embodiments of the invention are illustrated. In these figures, the same reference numerals are also employed as in the preceding examples, but in addition, in the schematic views, there are inserted reference numerals illustrating the connection with the support member, even though the support member is not shown in these figures.

Figure 10A:
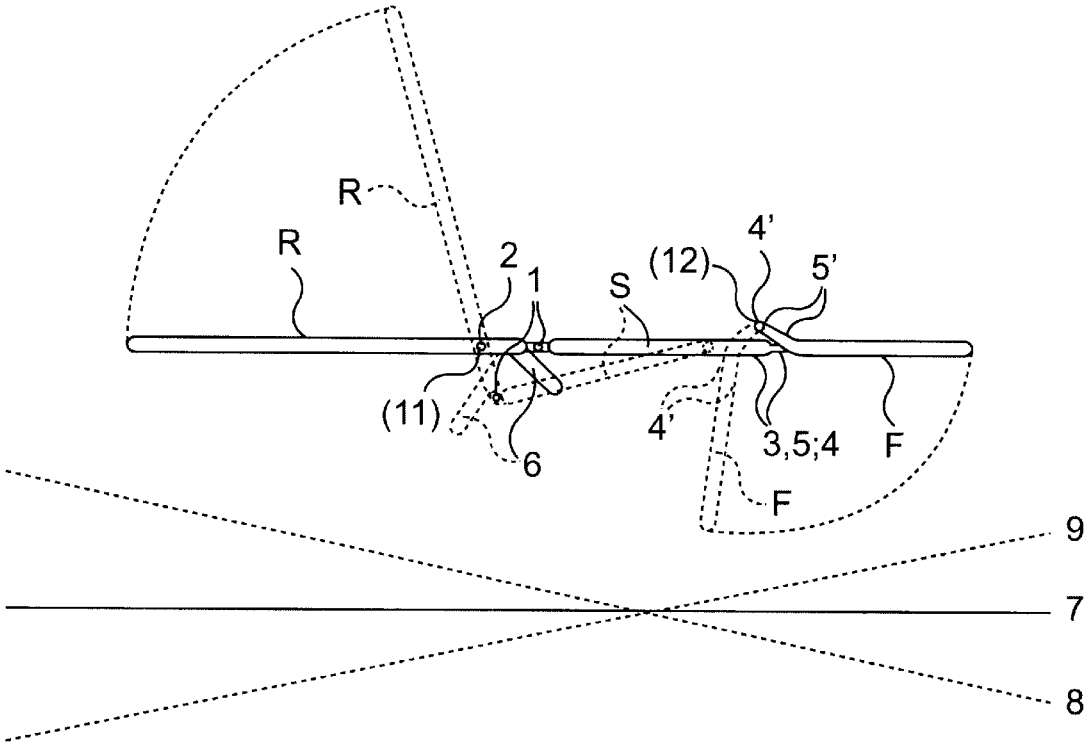
FIG. 10A is a schematic view corresponding to FIG. 1, illustrating a third embodiment of the invention.
Figure 10B:
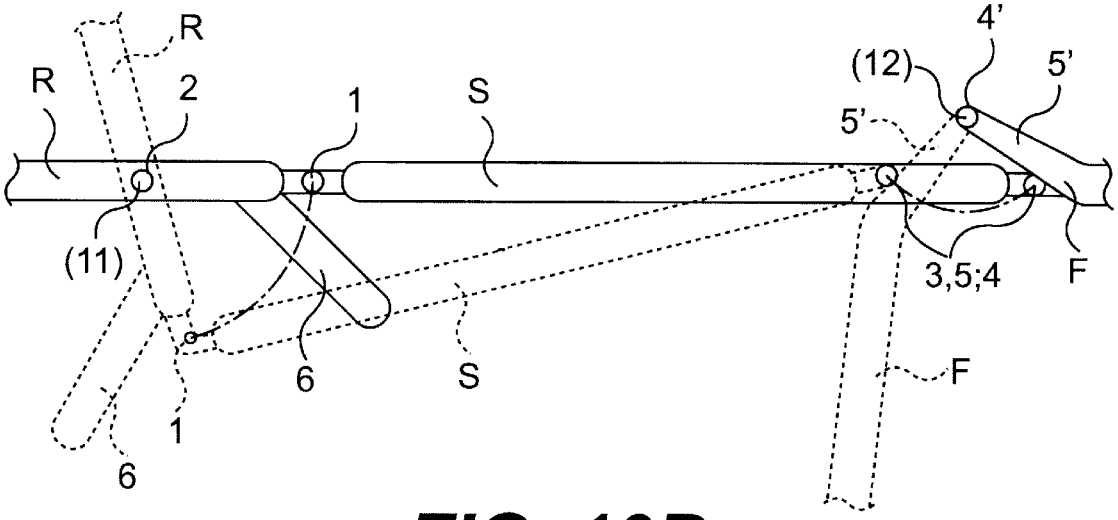
FIG. 10B is an enlarged detailed view of FIG. 10A, FIGS. 11A and 11B are perspective views of the embodiment in FIG. 10, where frame and support members are illustrated separately, FIGS. 12A/B are schematic views corresponding to FIGS. 10A and B of a fourth embodiment of the invention.
Figure 11A:
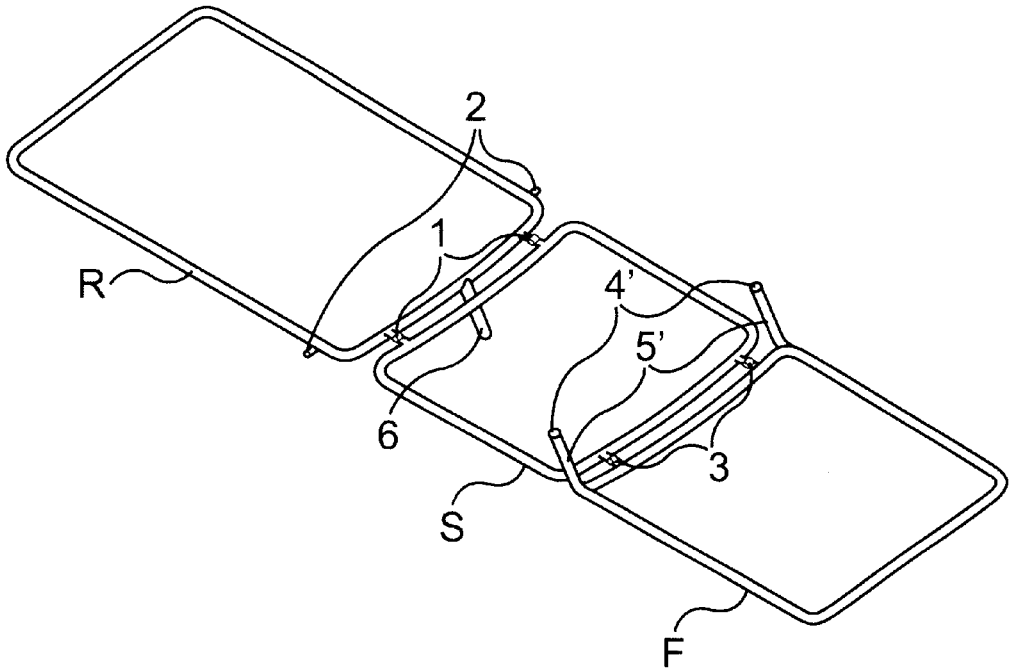
Figure 11B:
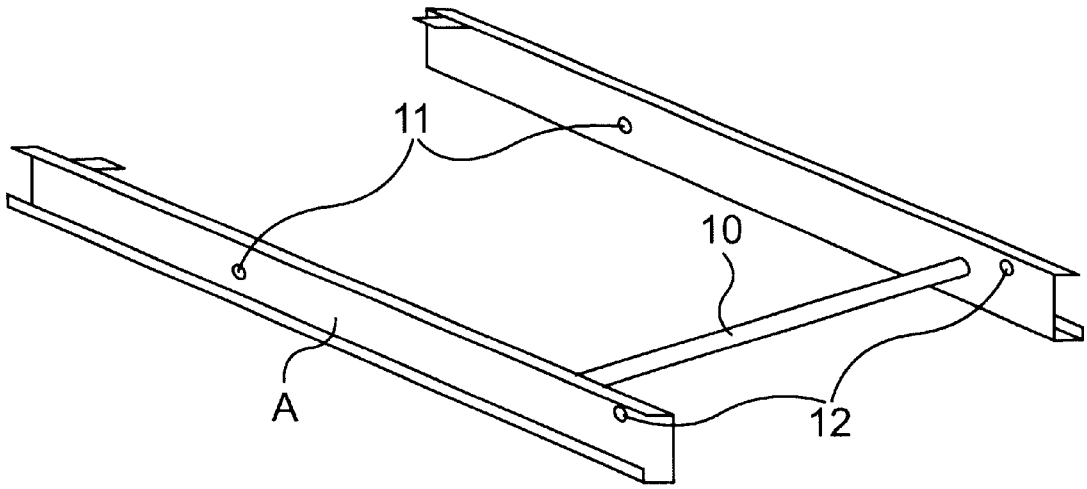

FIGS. 10A and 10B and FIG. 11 illustrate a design in which the fulcrum 3 of the seat member S coincides with the fulcrum 5 of the foot member F and where this common fulcrum 3, 5 also coincides with the link or the hinge 4 between the seat member and the foot member. The common fulcrum 3, 5 is provided at the lower end of an arm or extension 5' of the foot member F. The arm 5' is rotatable about a point 4' which is located above the plane of the frame. Thus in this variant the foot member F is extended with a fixed angular extension 5' from the hinged joint 3 between the seat member S and the foot member F, the angular extension 5' thereby acting as a lever or supporting stay which is attached/mounted rotating in the fixed point 4' in the support member. This point in the support member is designated 12 and is located above the joint 4 between the seat member and the foot member. During an angular alteration of the back member R the link axle 1 between the back member R and the seat member S will move in a circular arc, outwardly from the, plane of the frame, round the back's suspension axis 2, as illustrated in FIG. 10B. Such an angular alteration of the back member R moves the seat member S, which in turn moves the linkage 3 between the seat member S and the foot member F in a circular arc round the rotating axis 4' for the arm 5'. The design permits the angle between back member and seat member to be adjusted between 180° and up to 90°, while at the same time the angle between seat member and foot member is adjusted between 180° and up to 300° or more. The solution is particularly suitable for a reclining chair or another type of chair, in which the foot member in the sitting position should be able to or can be pulled some distance under the seat member. The angle between the seat member and the foot member will be dependent on the distances between 4' and 3 relative to the distance between 2 and 1 and/or the angle for the extension of the foot member, i.e., the arm member 5'. This extension 5' does not necessarily have to have the angle illustrated, but an angular extension will bring the foot member under the seat member earlier than if the lever 5' is designed straight.

Figure 12A:
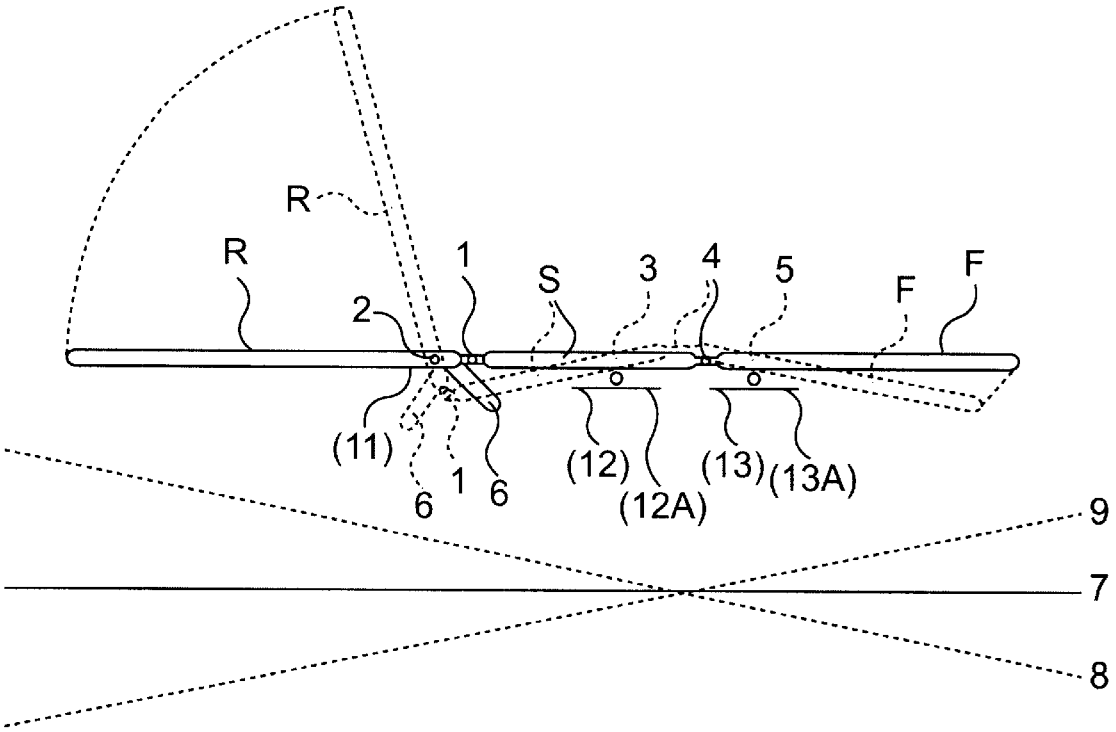
Figure 12B:
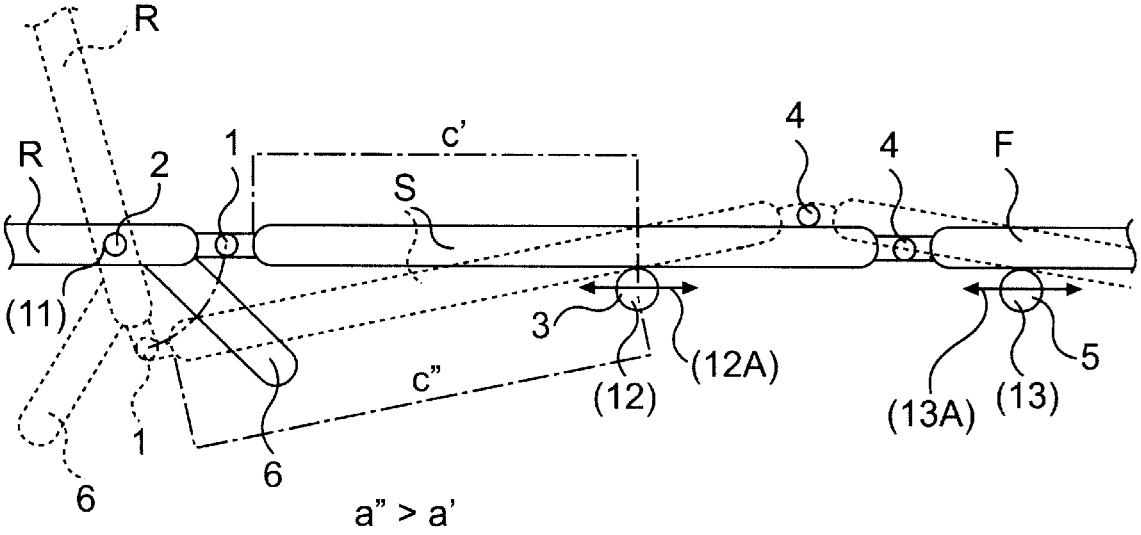
Figure 13A:
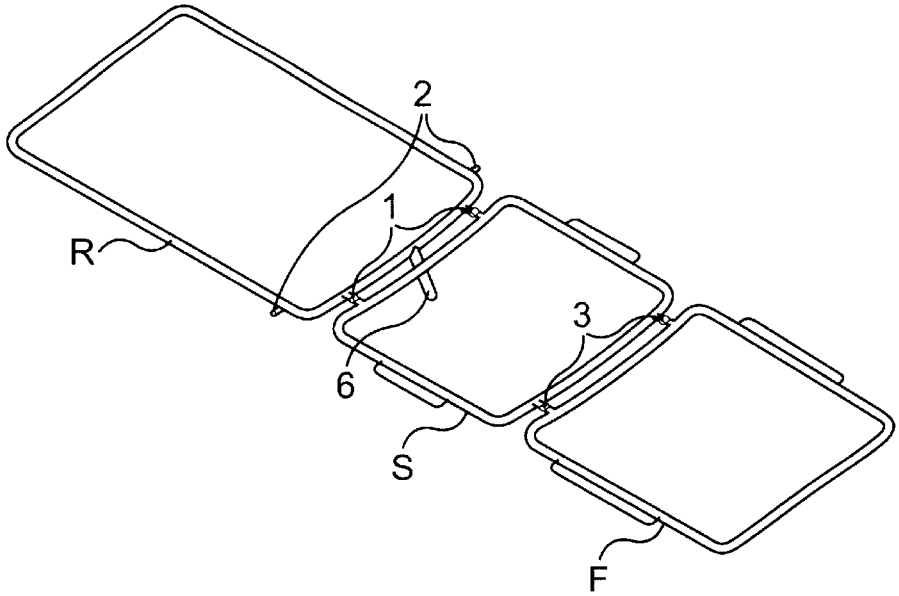
FIGS. 13A and 13B are perspective views of the frame and support members illustrated separately corresponding to the embodiment in FIG. 12, FIGS. 14A/B are schematic views corresponding to FIG. 10 of a fifth embodiment.
Figure 13B:
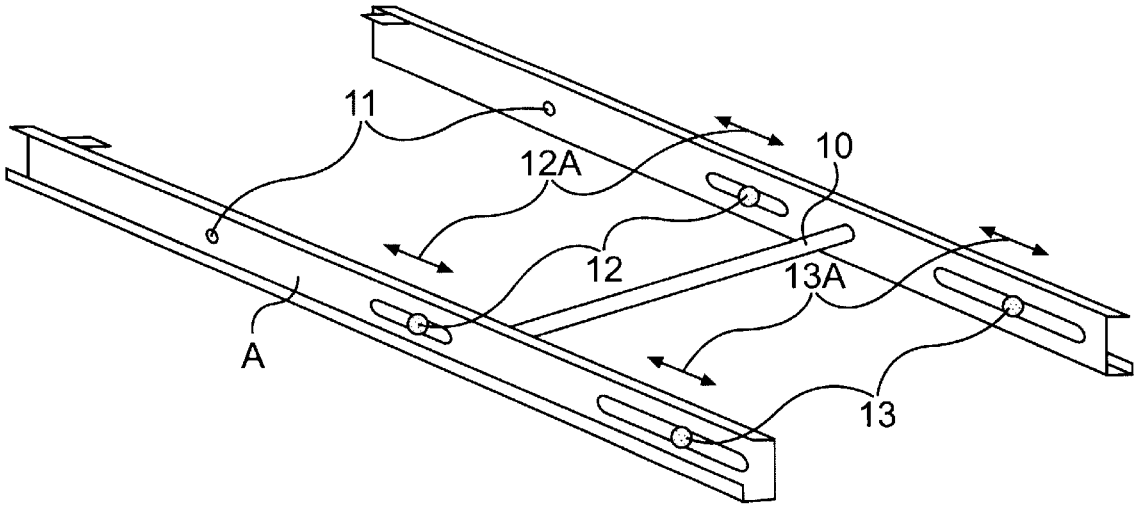

A further variant of the invention is illustrated in FIGS. 12A, B and FIG. 13. This variant consists in the seat member S moving or sliding along a fixed axle or fulcrum 3, which is attached to the support member at point 12, but which, if so desired, can be moved in the support member's longitudinal direction, as illustrated by the double arrow 12A. A similar principle may be introduced for the foot member F, which moves or slides along a fixed axle 5 attached to the support member at point 13. This fulcrum 5 may also advantageously be moved in the support member's longitudinal direction as indicated by the double arrow 13A. In order to facilitate the movement the rotating axles 3 and 5 can rotate or roll. This principle makes it possible to perform an infinitely variable adjustment of the angle between back member and seat member between 180° and 90°, thereby adjusting the angle between seat member and foot member between 180' and up to approximately 220°. On condition that the angle between back member and seat member is not equal to 180°, it will be possible to set altered angles for seat member and/or foot member separately without changing the back angle. Similarly, it will be possible to alter the angle between seat member and foot member, even though the seat member does not move when the angle between seat member and foot member is different from 180°.

Figure 14A:
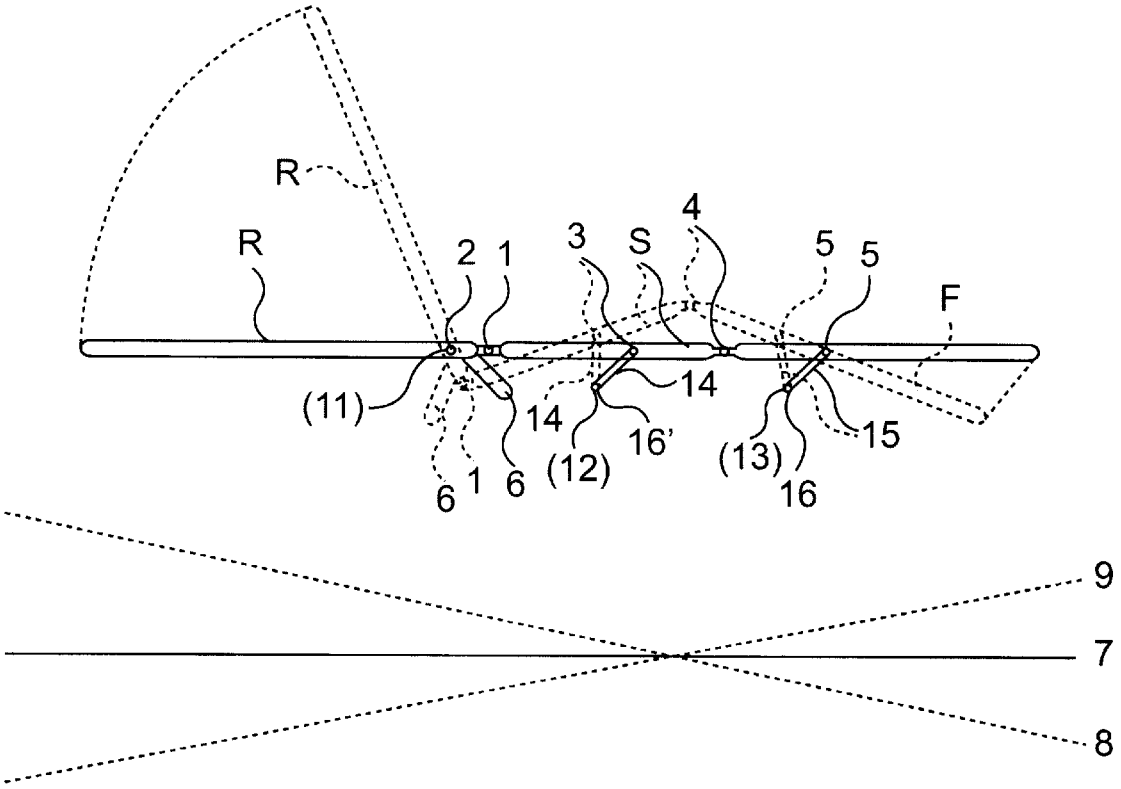
Figure 14B:
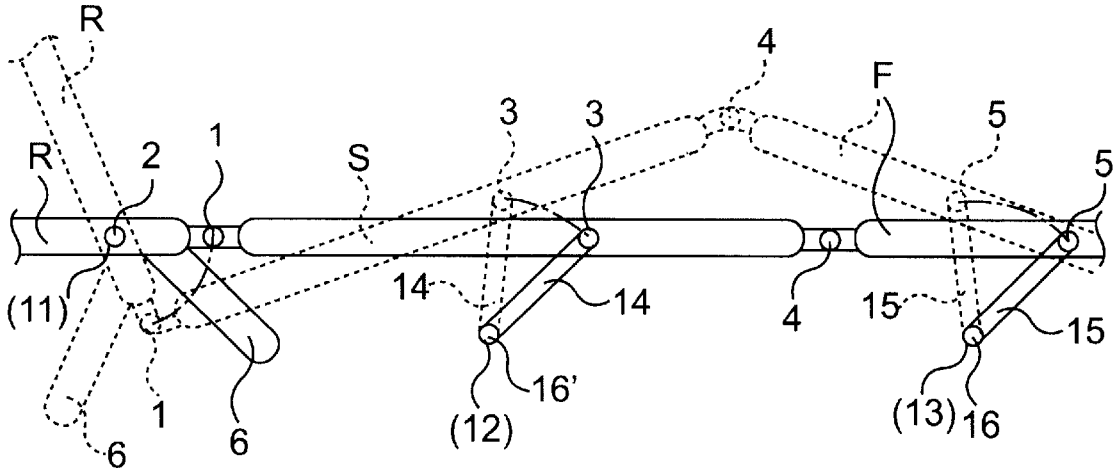
Figure 15A:
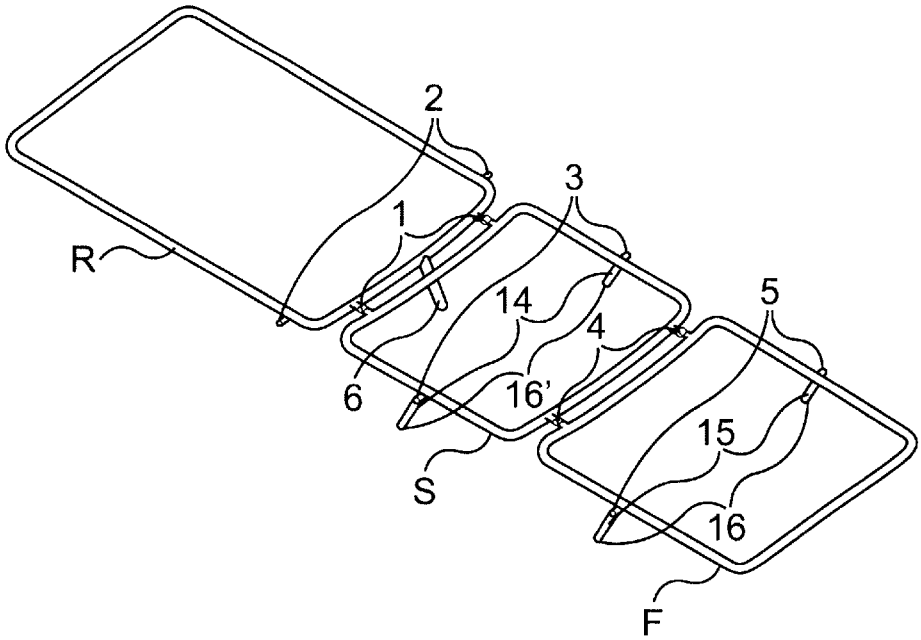
FIGS. 15A and 15B are perspective views corresponding to the embodiment in FIG. 14 where the frame and support members have been separated, FIGS. 16A/B is a variant of the embodiment in FIG. 14 in a similar view to FIG. 14, FIGS. 17A and 17B are perspective views corresponding to the embodiment in FIG. 16, and FIGS. 18 and 19 are perspective views of an embodiment corresponding to FIG. 8 with a neck support device shown in two positions.
Figure 15B:
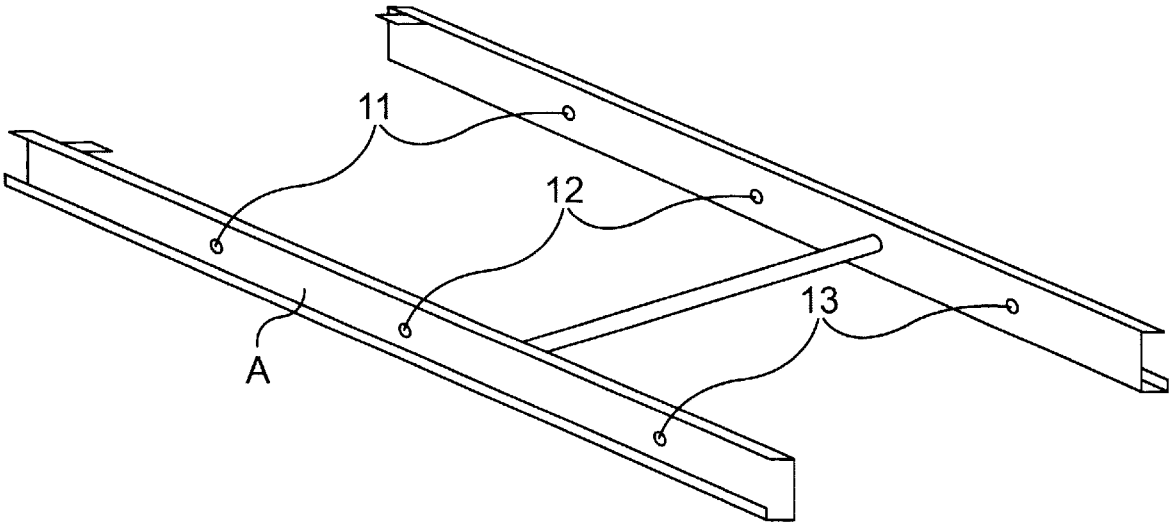
Figure 16A:
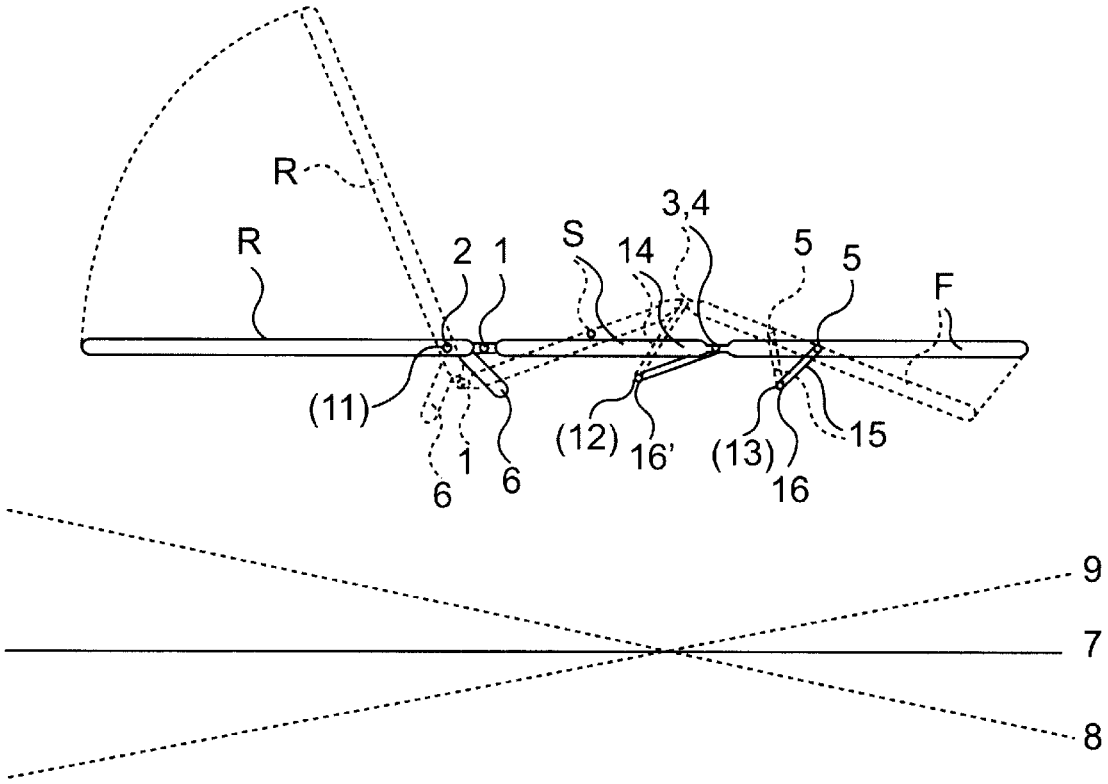
Figure 16B:
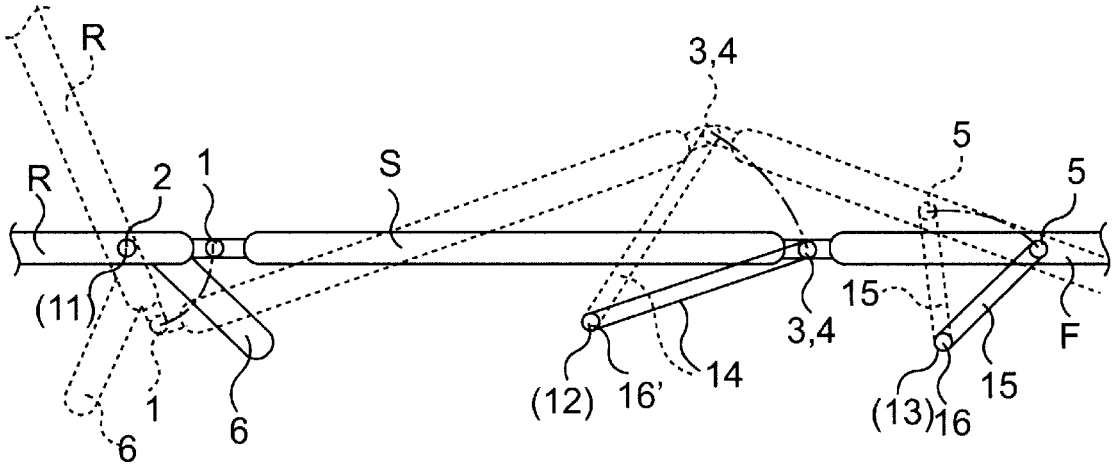
Figure 17A:
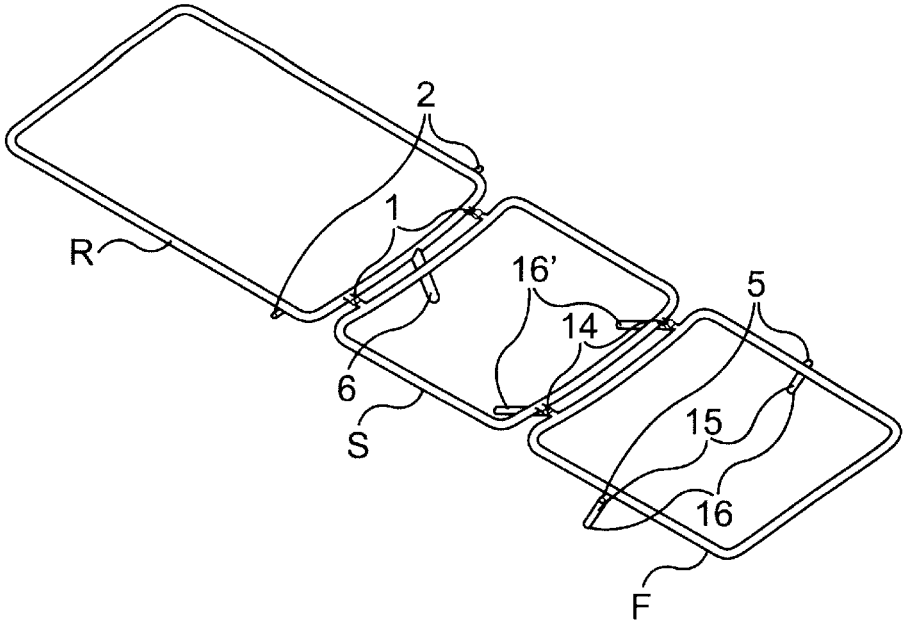
Figure 17B:
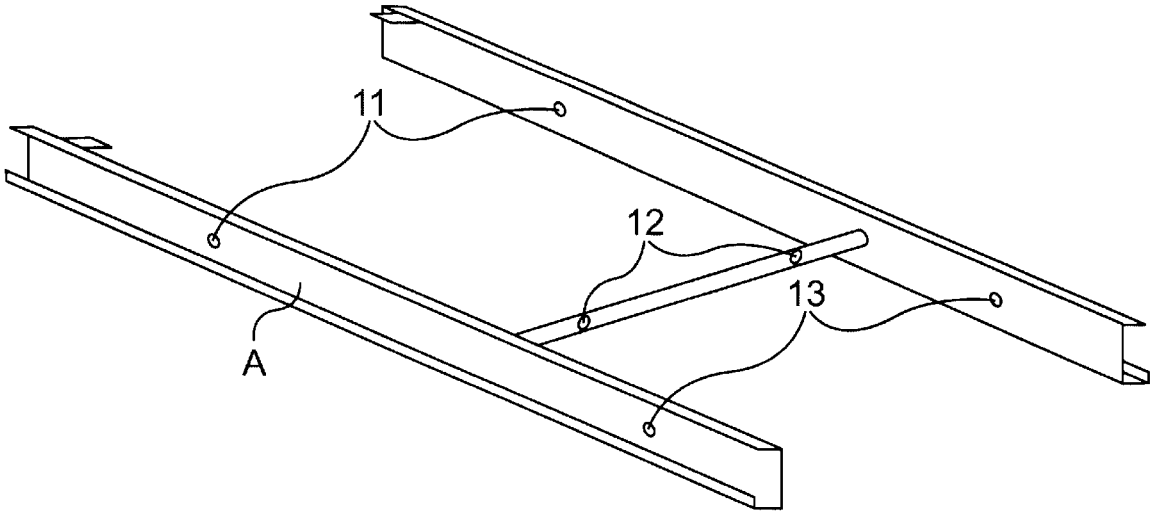

In a further variant illustrated in FIGS. 14A, 14B, and 15, the rotating pin 3 of the seat member S is rotatably attached either to the central area of the seat member as illustrated in FIGS. 14 and 15, in the seat member closer to the articulated hinge 4, or in the articulated hinge 4, as illustrated in FIGS. 16 and 17. From the seat member's rotating pin 3 a lever 14 descends to a fixed, rotatable attachment point in the support member at point 12. In FIGS. 14 and 16 this fulcrum is designated 16'. The lever 14, which is rotated about fixed points both in the seat member S and the support member, will then act as a pendulum when the back member changes position, pulling along with it the seat member S. The length of the lever 14 between seat member S and support member and the location of the attachment points 3 and 16' will thus determine the seat's angle together with the curved movement of the link.

The same principle may then also be introduced for the foot member, the foot member's rotating pin 5 being rotatably attached at a suitable point on the foot member. The rotating pin 5 is connected via an arm 15 to a fixed, but rotatable attachment 16 in the support member at point 13. The lever 15, which rotates about fixed fulcrums both in the foot member and the support member, will thereby act as a pendulum when the back member R changes position, pulling along with it the seat member S and the foot member. The length of the lever 15 and the location thereof will then determine the angle together with the curved movement.

It should be noted that it will also be possible to employ variants of the illustrated embodiments, since, e.g., a mechanism from one embodiment may be combined with elements from another embodiment. All such combinations are intended to fall within the scope of the invention.

Figure 18:
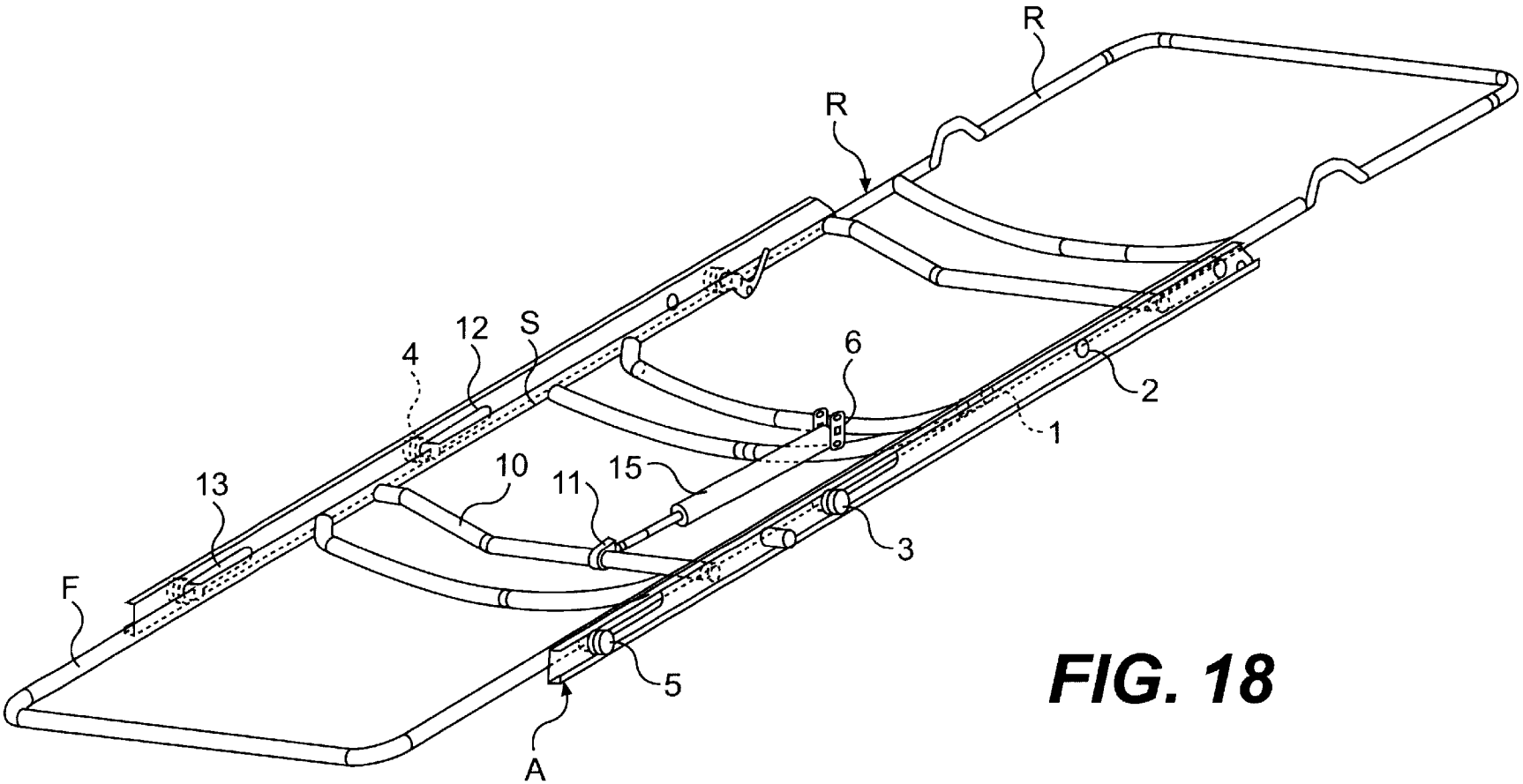
Figure 19:
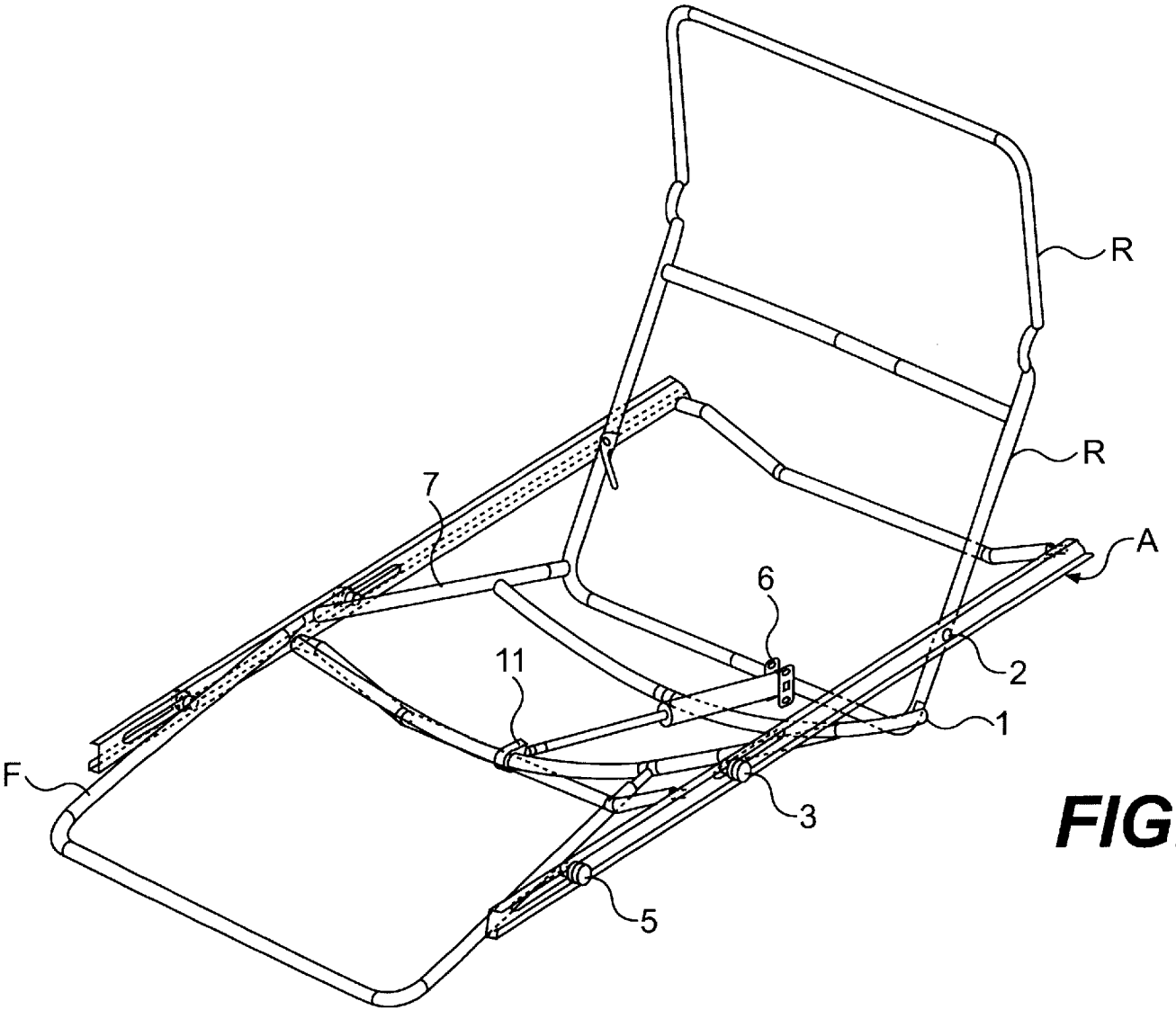

Reference is also made to a special modification according to the invention, illustrated in FIGS. 18 and 19, where the back member is equipped with an extra link which forms a neck cushion or neck support, in order to provide a more comfortable position when the piece of furniture is employed in a sitting position or semi-sitting position. In Norwegian Patent No. 176 384 (owner Ekornes), a neck support device is described for an adjustable chair, where the neck support is automatically raised when the chair is lowered into a reclining position. According to a feature of the invention, a similar device may also be employed on the back member according to the invention, but arranged in such a manner that the neck support is pulled forward when the back is raised, i.e., with the result that it has the opposite effect to that which is described in the Ekornes patent. It is such a design which is illustrated in FIGS. 18 and 19. It will also be possible to employ other means for adjusting the neck support. The mechanism which is employed in this connection is described in the patent and in the present invention is mounted on the back member, only acting in the opposite direction. With regard to the description thereof, reference is made to the above-mentioned application.

In the drawings the invention is only illustrated by means of principle drawings, and it should be quite obvious that it will be possible to design the individual parts of the frame in many different ways, with many different types of support elements. These features do not constitute components of the actual invention and are therefore not illustdrated in more detail. The use of different possibilities for variation will be obvious to a person skilled in the art. Joint and axle mounting are also indicated purely in principle. It will be possible for a person skilled in the art to vary these elements too, e.g., by introducing an extra degree of freedom for one or more axles. It may also be conceivable that a frame of this kind may be designed with more parts, and this too will fall within the scope of the invention.

What is claimed is:

1. An adjustable article of furniture having a length and comprising:

a supporting member;

a hinged frame including a back frame member having a bottom end and a one-piece seat frame member having front and rear ends, the bottom end of the back member being connected directly to the rear end of the seat member by a hinge having a single hinge axis, means for mounting said hinged frame in the supporting member including a first pair of horizontally aligned transverse fulcrums positioned on the back frame member at a first distance from the hinge axis and pivotally received in a fixed journal on the supporting member, and a second pair of horizontally aligned fulcrums on the one-piece seat frame member and carried by the supporting member for movement through a second distance along the length of the article of furniture, and a downwardly directed lever arm securely connected with the back member for controlling angular displacement of the back frame member.

2. The adjustable article of furniture of claim 1, wherein the second pair of horizontally aligned fulcrums is defined by aligned axles movable by rolling in guide slots provided in the support member or in members mounted thereon.

3. An adjustable article of furniture having a length and comprising:

a supporting member;

a hinged frame including a back member having a bottom end, a seat member having front and rear ends, the bottom end of the back member being connected directly to the rear end of the seat member by a hinge having a hinge axis, means for mounting said hinged frame in the supporting member including a first pair of horizontally aligned transverse fulcrums positioned on the back member at a first distance from the hinge axis and pivotally received in a fixed journal on the supporting member, and a second pair of horizontally aligned fulcrums on the seat member and carried by the supporting member for movement through a second distance along the length of the article of furniture, and a downwardly directed lever arm securely connected with the back member for controlling angular displacement of the back member, the hinged frame further including a foot member hinged to the front end of the seat member and having a third pair of horizontally aligned fulcrums fixed relative to a point on the support member, wherein the second pair of fulcrums is coincident with the hinging of the foot member to the front end of the seat member and movable relative to the fixed point in the direction of the length of the frame.

4. The adjustable article of furniture of claim 3, wherein the second and third pairs of horizontally aligned fulcrums are arranged in a central area of the respective seat and foot members.

5. An adjustable article of furniture having a length and comprising:

a supporting member;

a hinged frame including a back member having a bottom end and a seat member having front and rear ends, the bottom end of the back member being connected directly to the rear end of the seat member by a hinge having a hinge axis, means for mounting said hinged frame in the supporting member including a first pair of horizontally aligned transverse fulcrums positioned on the back member at a first distance from the hinge axis and pivotally received in a fixed journal on the supporting member, and a second pair of horizontally aligned fulcrums on the seat member and carried by the supporting member for movement through a second distance along the length of the article of furniture, and a downwardly directed lever arm securely connected with the back member for controlling angular displacement of the back member, the hinged frame further including a foot member hinged to the front end of the seat member and having a third pair of horizontally aligned fulcrums, one of the second and third pair of aligned fulcrums being fixed at a point on one of the respective seat and foot members and rotatably connected with one end of an arm having another end rotatably connected with the support member at a lower point so that the arm may assume an oblique angle relative to the other of the second and third pair of aligned fulcrums.

6. The adjustable article of furniture of claim 5 wherein the second and third pairs of horizontally aligned fulcrums are arranged in a central area of the respective seat and foot members.

7. The adjustable article of furniture of claim 5, including a pair of arms, each having one end pivoted to the second and third pair of horizontally aligned fulcrums, respectively, the opposite end of each of the pair of arms pivoted to the second pair of aligned fulcrums being rotatably attached at the hinge axis between the seat member and the foot member, and the opposite end of each of the pair of arms pivoted to the third pair of horizontally aligned fulcrums being rotatably connected with the support member at a lower point.

8. An adjustable article of furniture having a length and comprising:

a supporting member;

a hinged frame including a back member having a bottom end and a seat member having front and rear ends, the bottom end of the back member being connected directly to the rear end of the seat member by a hinge having a hinge axis, means for mounting said hinged frame in the supporting member including a first pair of horizontally aligned transverse fulcrums positioned on the back member at a first distance from the hinge axis and pivotally received in a fixed journal on the supporting member, and a second pair of horizontally aligned fulcrums on the seat member and carried by the supporting member for movement through a second distance along the length of the article of furniture, and a downwardly directed lever arm securely connected with the back member for controlling angular displacement of the back member, the hinged frame further including a foot member hinged to the front end of the seat member and having a third pair of horizontally aligned fulcrums, and wherein the second and third pairs of horizontally aligned fulcrums are coincident at a common pivot axis and the common pivot axis is arranged at the end of an angular extension of the foot member.

9. An adjustable article of furniture having a length and comprising:

a supporting member;

a hinged frame including a back member having a bottom end and a seat member having front and rear ends, the bottom end of the back member being connected directly to the rear end of the seat member by a hinge having a hinge axis, means for mounting said hinged frame in the supporting member including a first pair of horizontally aligned transverse fulcrums positioned on the back member at a first distance from the hinge axis and pivotally received in a fixed journal on the supporting member, and a second pair of horizontally aligned fulcrums on the seat member and carried by the supporting member for movement through a second distance along the length of the article of furniture, and a downwardly directed lever arm securely connected with the back member for controlling angular displacement of the back member, the back member including a joint mechanism for an automatically adjustable neck support on the back member.

10. An adjustable article of furniture having a length and comprising:

a supporting member;

a hinged frame including a back member having a bottom end and a seat member having front and rear ends, the bottom end of the back member being connected directly to the rear end of the seat member by a hinge having a hinge axis, means for mounting said hinged frame in the supporting member including a first pair of horizontally aligned transverse fulcrums positioned on the back member at a first distance from the hinge axis and pivotally received in a fixed journal on the supporting member, and a second pair of horizontally aligned fulcrums on the seat member and carried by the supporting member for movement through a second distance along the length of the article of furniture, and a downwardly directed lever arm securely connected with the back member for controlling angular displacement of the back member, and mounting an operating mechanism for angular displacement of the back member, and for locking the back member in any position of adjustment.

11. An adjustable article of furniture having a length and comprising:

a supporting member;

a hinged frame including a back member having a bottom end and a seat member having front and rear ends, the bottom end of the back member being connected directly to the rear end of the seat member by a hinge having a hinge axis, means for mounting said hinged frame in the supporting member including a first pair of horizontally aligned transverse fulcrums positioned on the back member at a first distance from the hinge axis and pivotally received in a fixed journal on the supporting member, and a second pair of horizontally aligned fulcrums on the seat member and carried by the supporting member for movement through a second distance along the length of the article of furniture, and a downwardly directed lever arm securely connected with the back member for controlling angular displacement of the back member, and, wherein the support member is tiltable through an angle of about 12 degrees in relation to a floor surface.

12. An adjustable article of furniture having a length and comprising:

a supporting member;

a hinged frame including a back member having a bottom end and a seat member having front and rear ends, the bottom end of the back member being connected directly to the rear end of the seat member by a hinge having a hinge axis, means for mounting said hinged frame in the supporting member including a first pair of horizontally aligned transverse fulcrums positioned on the back member at a first distance from the hinge axis and pivotally received in a fixed journal on the supporting member, and a second pair of horizontally aligned fulcrums on the seat member and carried by the supporting member for movement through a second distance along the length of the article of furniture, the second pair of horizontally aligned fulcrums being defined by aligned axles movable by rolling in guide slots provided in the supporting member mounted thereon; and a downwardly directed lever arm securely connected with the back member for controlling angular displacement of the back member, the hinged frame further including a foot member hinged to the front end of the seat member and having a third pair of horizontally aligned fulcrums, the third pair of horizontally aligned fulcrums having a larger displacement in the support member than that of the second pair of aligned fulcrums.

13. An adjustable article of furniture having a length and comprising:

a supporting member;

a hinged frame including a back member having a bottom end and a seat member having front and rear ends, the bottom end of the back member being connected directly to the rear end of the seat member by a hinge having a hinge axis, means for mounting said hinged frame in the supporting member including a first pair of horizontally aligned transverse fulcrums positioned on the back member at a first distance from the hinge axis and pivotally received in a fixed journal on the supporting member, and a second pair of horizontally aligned fulcrums on the seat member and carried by the supporting member for movement through a second distance along the length of the article of furniture, the second pair of horizontally aligned fulcrums being defined by aligned axles movable by rolling in guide slots provided in the supporting member mounted thereon; and a downwardly directed lever arm securely connected with the back member for controlling angular displacement of the back member, wherein the first distance is selected so that the angle between the seat and back members is infinitely variable for adjustment between 180 degrees and 90 degrees, the second pair of horizontally aligned fulcrums being movable forwards and backwards along an approximately straight line in relation to the first pair of horizontally aligned fulcrums.

14. An adjustable article of furniture having a length and comprising:

a supporting member;

a hinged frame including a back member having a bottom end and a seat member having front and rear ends, the bottom end of the back member being connected directly to the rear end of the seat member by a hinge having a hinge axis, means for mounting said hinged frame in the supporting member including a first pair of horizontally aligned transverse fulcrums positioned on the back member at a first distance from the hinge axis and pivotally received in a fixed journal on the supporting member, and a second pair of horizontally aligned fulcrums on the seat member and carried by the supporting member for movement through a second distance along the length of the article of furniture, the second pair of horizontally aligned fulcrums being defined by aligned axles movable by rolling in guide slots provided in the supporting member mounted thereon; and a downwardly directed lever arm securely connected with the back member for controlling angular displacement of the back member, wherein the hinged frame further includes a foot member hinged to the front end of the seat member and having a third pair of horizontally aligned fulcrums, and wherein the second and third pairs of horizontally aligned fulcrums are movable in the support member along an approximately straight line so that an angular adjustment of between about 180 degrees and 90 degrees between the back member and the seat member causes an angular change of between about 180 degrees and 220 degrees between the seat member and the foot member.

* * * * *